US007021208B2

(12) United States Patent
Du et al.

(10) Patent No.: US 7,021,208 B2
(45) Date of Patent: Apr. 4, 2006

(54) COMPRESS AND POSITION APPARATUS

(75) Inventors: Chen-Chung Du, Hsinchu (TW); Pang-Ming Chiang, Hsinchu (TW); Jen-Rong Huang, Hsinchu (TW); Muh-Wang Liang, MiaoLi (TW); Yi-Chao Weng, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 186 days.

(21) Appl. No.: 10/764,586

(22) Filed: Jan. 27, 2004

(65) Prior Publication Data

US 2005/0051023 A1 Mar. 10, 2005

(30) Foreign Application Priority Data

Sep. 10, 2003 (TW) ..... 92124974 A

(51) Int. Cl.
*B30B 1/32* (2006.01)

(52) U.S. Cl. ..... 100/269.12; 100/258 A; 100/269.18

(58) Field of Classification Search ..... 100/258 R, 100/258 A, 269.12, 245, 269.2, 269.21, 269.18; 72/446, 456, 465.1, 466; 269/17, 24, 27, 269/32; 156/580

See application file for complete search history.

(56) References Cited

U.S. PATENT DOCUMENTS 2,302,132 A * 11/1942 MacMillin et al. ..... 100/258 A
2,343,167 A * 2/1944 Bench ..... 100/46
2,600,164 A * 6/1952 Heywood ..... 269/21
6,156,167 A * 12/2000 Patton et al. ..... 204/270

* cited by examiner

*Primary Examiner*—Dennis H. Banks
*Assistant Examiner*—Jimmy Nguyen
(74) *Attorney, Agent, or Firm*—Birch, Stewart, Kolasch & Birch, LLP

(57) ABSTRACT

The present invention relates to a compress and position apparatus with positioning, orientating functions and providing more uniform pressing force compliantly. The compress and position apparatus comprises a guiding column, a base, a housing, a seat, a annular portion and a pressing plate. The base has a cylinder, a plurality of locating pins and a convex portion. The annular portion has a through hole and a plurality of locating holes. The guiding column and the cylinder are disposed in the housing provided with an opening for the guiding column passing therethrough. The housing is mounted on the base and passed through a through hole of the annular portion and disposed in a cavity of the seat. A plane on the housing abuts a plane on the cavity to prevent the rotation of the housing. The guiding column is combined with the seat. The locating pin is inserted into the locating hole. The pressing plate engages the annular portion. Thus the guiding column is moved up and down by the gas supply device. The convex portion biases the pressing plate to exert force on the substrate.

14 Claims, 6 Drawing Sheets

COMPRESS AND POSITION APPARATUS

This Nonprovisional application claims priority under 35 U.S.C. § 119(a) on Patent Application No. 092124,974 filed in TAIWAN on Sep. 10, 2003, the entire contents of which are hereby incorporated by reference.

BACKGROUND OF THE INVENTION

1. Field of the Invention

The present invention relates to a compress and position apparatus, and more particularly, to a compress and position apparatus with positioning, orientating functions and providing more uniform pressing force.

2. Background of the Invention

In wafer bump electroplating technology, a substrate such as wafer is placed on a cathode, and metal ions from anode and plating solution are attached on the wafer to form a metal bump. A conventional electroplating method is disclosed in U.S. Pat. No. 6,156,167. A wafer is placed on a seal, and a base of a compress and position apparatus is directly pressed on the rim of the wafer so that the seal under the wafer is deformed to prevent the plating solution from polluting the region in the back of the wafer.

FIG. 1 is a schematic view of a conventional compress apparatus. Referring to FIG. 1, the conventional compress and position apparatus comprises a guiding column 102, a base 104 and a housing 106. The housing 106 is mounted on the base 104, and the guiding column is positioned in a space formed by the housing 106 and the base 104.

The guiding column 102 has a first end 112 and a corresponding second end 114. The first end 112 is fixed and the diameter of the second end 114 is greater than the diameter of the first end 112. The second end 114 has a groove 116 receiving an elastic element 118 such as an O-ring so that the second end 114 can abut the inner wall of the housing 106 by the elastic element 118 when the housing 106 moves.

In addition, the housing 106 has a central opening 120 on the top thereof and a first vent 122 and a second vent 124 on the lateral surface thereof. The central opening 120 also has a groove 126 receiving an elastic element 128 such as an O-ring. As described above, the first end 112 of the guiding column 102 is fixed. For more detail, the first end 112 passes through the central opening 120 of the housing 106 and is fixed onto other component outside. The elastic element 128 received in the opening 120 abuts the guiding column 102 when the housing 106 moves up and down.

Therefore, in the conventional compress apparatus, when gas is provided through the first vent 122, the housing 106 and the base 104 rise up. When gas is provided through the second vent 124, the housing 106 and the base 104 lower down. The base 104 moves downward to press the substrate 110 such as a wafer disposed on a cathode 130 and a seal 108 such as a sealing lip or an O-ring.

However, in such conventional compress apparatus, the base must be parallel to the seal to make the seal uniformly deformed so that an excellent sealing is available. If the base is inclined toward the seal, the seal have to compensate the incline so that non-uniform deformation of the seal will occur when the substrate is pressed by the base. Particularly in largeincline between base and seal, a portion of the seal may not function well so that the plating solution will leak to pollute the back of the wafer and the cathode. In such condition, if the pressing force is increased to avoid such bad sealing, the wafer is easily broken, particularly for a thin wafer.

Moreover, the base of prior art will rotate and is inapplicable for plating the directional wafers.

SUMMARY OF THE INVENTION

Accordingly, an object of the invention is to provide a compress and position apparatus applicable to a directional wafer. The pressing plate is located by a locating pin. Upon that the pressing plate contacts the substrate, the locating pin escape from the locating hole to make the pressing plate abut the wafer so that the seal is pressed by a uniform force. Thereby, optimal sealing effect is achieved only by a suitable force.

The compress and position apparatus of the invention comprises a guiding column, a base, a housing, a seat, a annular portion and a pressing plate, wherein the guiding column and a cylinder of the base are disposed in the housing connected to the base. The housing passes through a through hole of the annular portion and is disposed in a cavity of the seat.

The guiding column has a first end and a second end corresponding to the first end. The diameter of the second end is greater than the diameter of the first end. The second end has a groove receiving an elastic element. The guiding column has a locating hole on the top thereof for the seat located thereon.

The base is under the guiding column and having a cylinder protruded in the center thereof. The diameter of the cylinder is substantially equal to the diameter of the second end. The cylinder has a groove receiving an elastic element. The base further has a first plane provided with at least one locating pin and a corresponding second plane provided with a convex portion.

The housing has a plane on lateral surface thereof and is mounted on the first plane. The housing has a central opening, a plurality of vents and a groove. A plurality of apertures is defined on the inner wall of the housing and connected to the vents. The guiding column and the cylinder are disposed in the housing. The first end of the guiding column passes through the central opening of the housing and is mounted to the seat. The housing has a groove on the top thereof for receiving an elastic element. The housing is connected to the first plane. The second end of the guiding column can not cover the first aperture and the second aperture.

The seat has a plane on the inner wall thereof and a cavity in the center thereof. The housing and the guiding column are disposed in the cavity. The plane on the inner wall is matched to the plane on the lateral surface of the housing to constrain the housing sliding in the axial direction but without rotation.

The annular portion is disposed on the first plane, and has a through hole defined at the center thereof for the housing passing therethrough and at least one locating hole corresponding to the locating pin on the first plane.

The pressing plate is disposed under and connected to the annular portion.

The compress and position apparatus of the invention is connected to a gas supply device. The locating pin of the base is engaged with the locating hole of the annular portion when the pressing plate has not contacted the substrate yet. The plane of the seat matches the plane of the housing so that the pressing plate will not offset or rotate. The gas supply device provides gas to lower the pressing plate down to contact the wafer. The distance H between the pressing plate and the convex portion is large enough for the locating pin escaping from the locating hole. The convex portion pushes the pressing plate to make the pressing plate completely and compliantly press the wafer and then make the wafer press the seal uniformly.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DESCRIPTION OF THE PREFERRED EMBODIMENT

Figure 1:
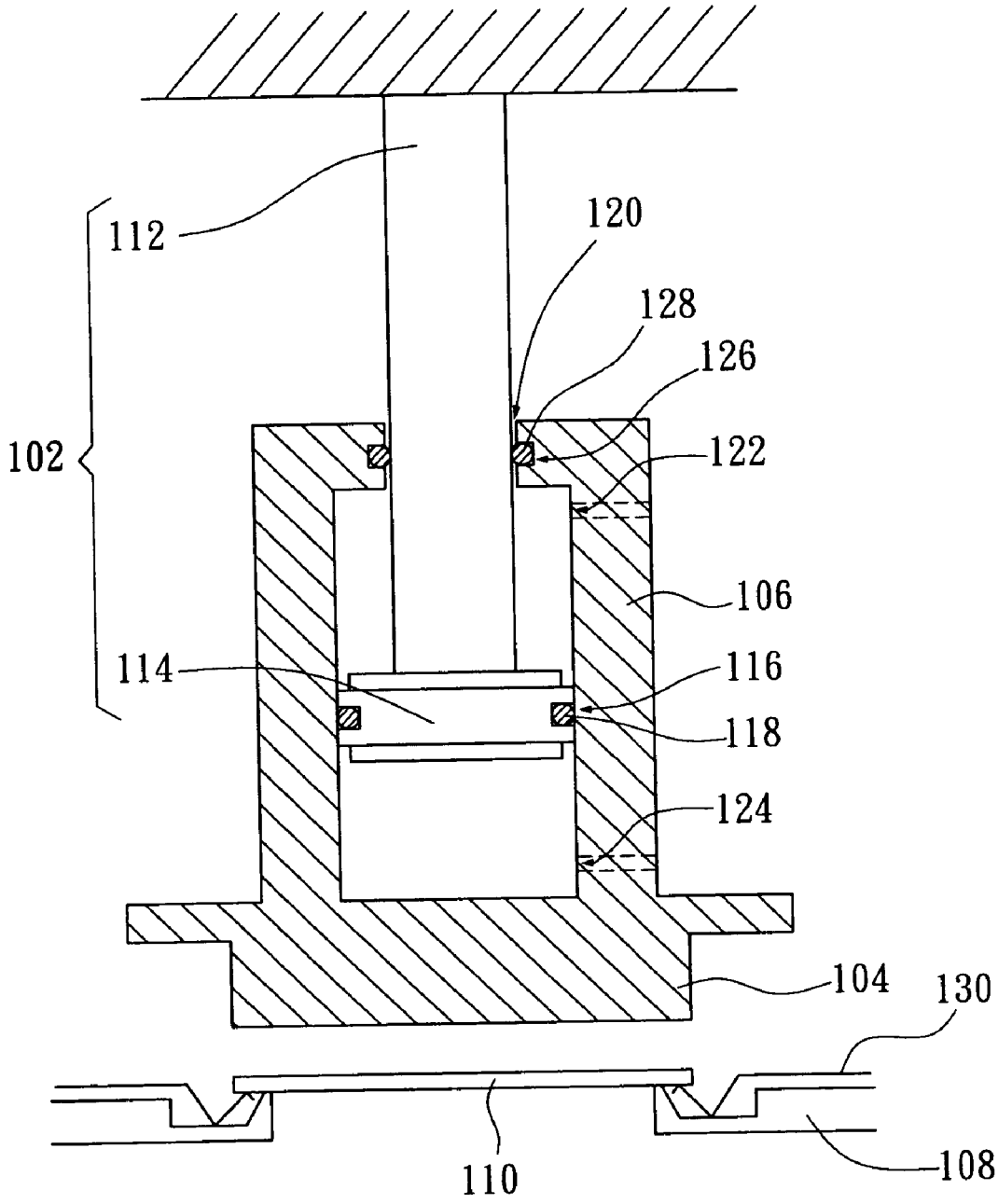
FIG. 1 (PRIOR ART)
FIG. 1 is a schematic view of a conventional compress apparatus and a substrate.
Figure 2:
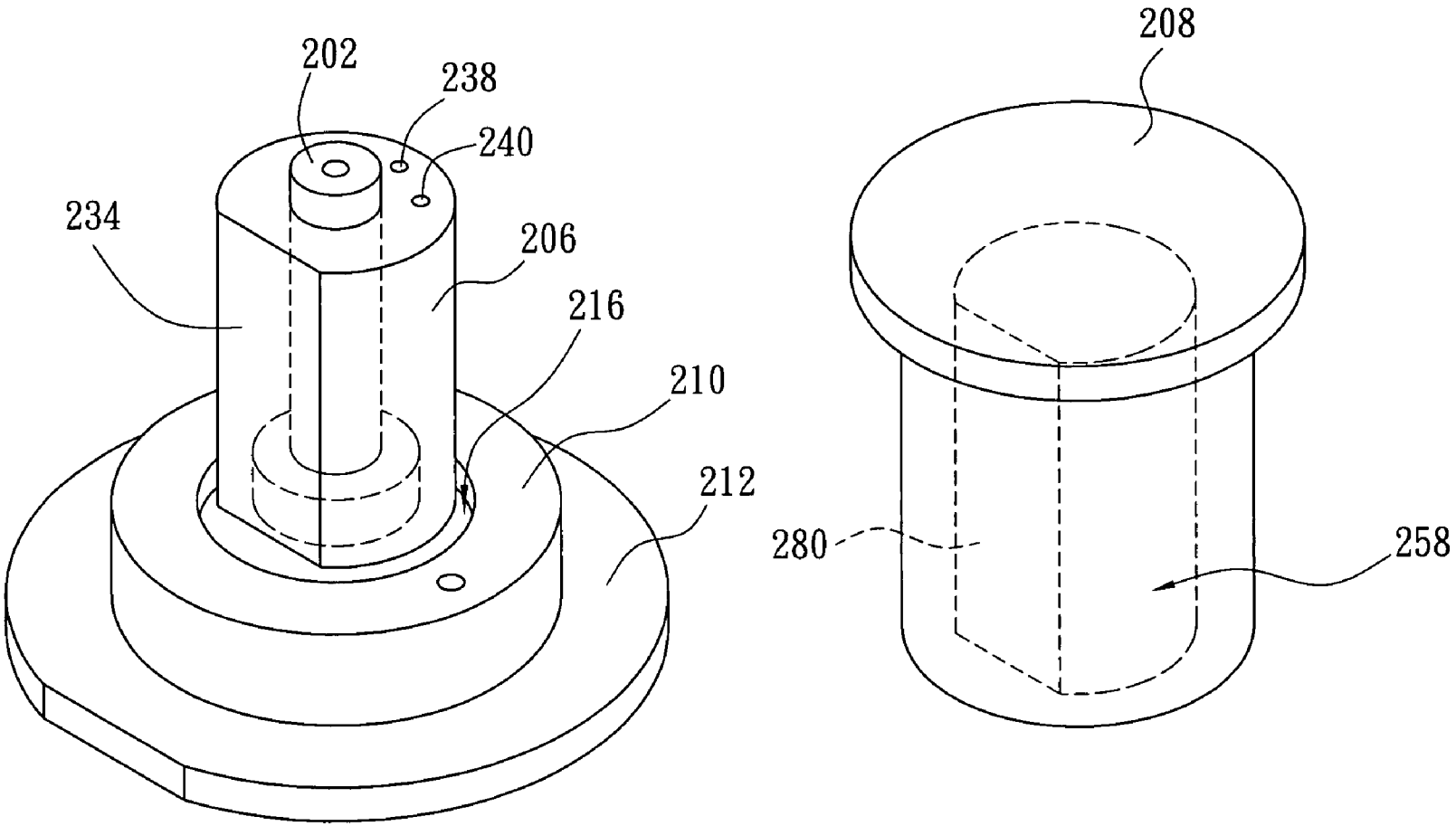
FIG. 2 is a schematic view of the embodiment in the invention.
Figure 3:
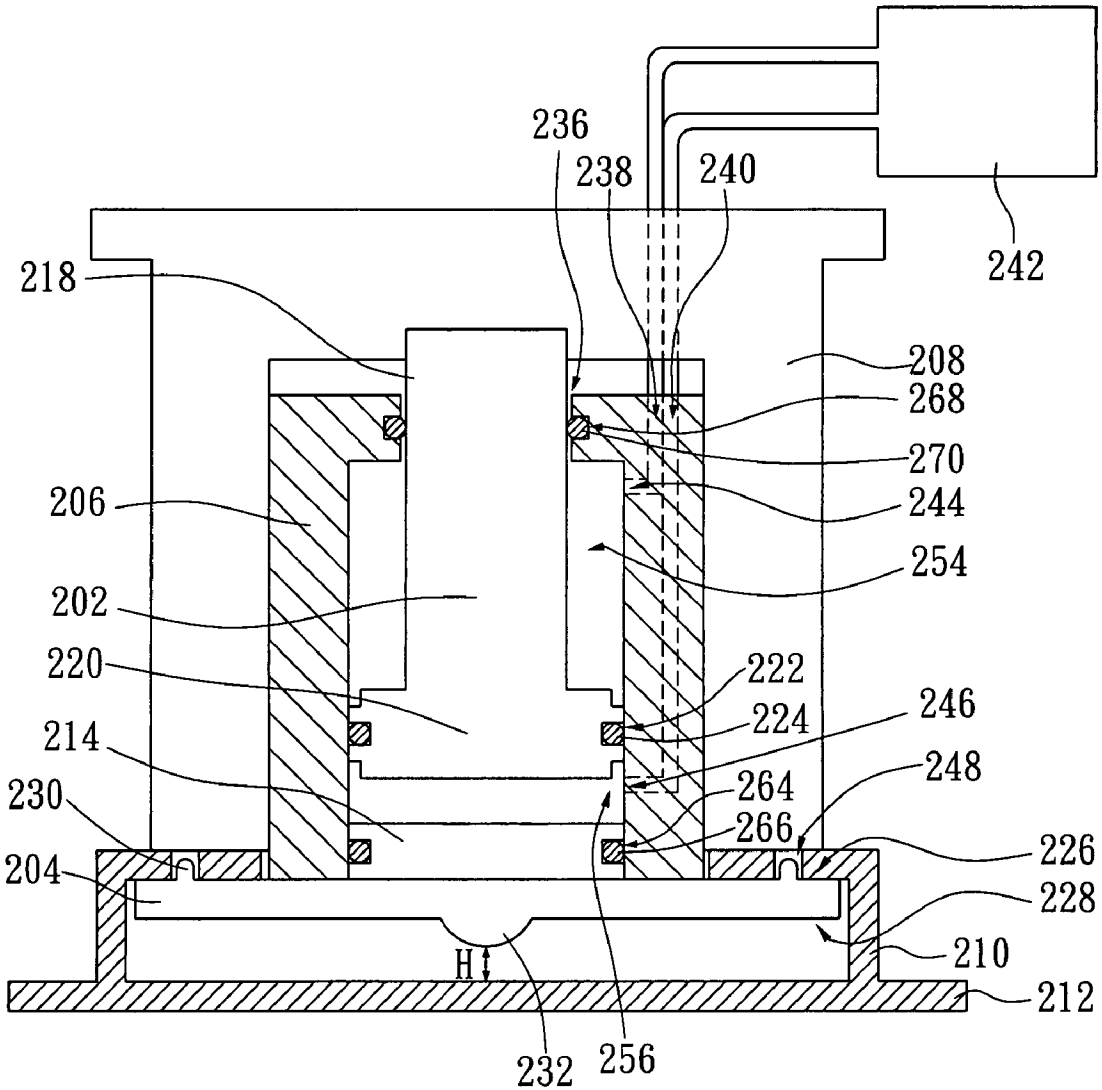
FIG. 3 is a cross section of the embodiment of the invention.

FIG. 2 is a schematic view of the embodiment in the invention. FIG. 3 is a cross section of the embodiment of the invention. Referring to FIGS. 2 and 3, the compress and position apparatus of the invention comprises a guiding column 202, a base 204, a housing 206, a seat 208, an annular portion 210 and a pressing plate 212, wherein the guiding column 202 is disposed in the housing 206 and the base 204 has cylinder 214 also disposed in the housing 206. The housing 206 is connected to the base 204. The housing 206 passes through a through hole 216 of the annular portion 210; the annular portion 210 is connected to the pressing plate 212; the guiding column 202 is connected to the seat 208.

Referring to FIGS. 2 and 3, the guiding column 202 has a first end 218 and a second end 220. The diameter of the second end 220 is greater than the diameter of the first end 218. The second end 220 has a groove 222 receiving an elastic element 224 made of rubber such as an O-ring. The elastic element 224 abuts the housing 206 to avoid gas leakage. The first end 218 extends into a cavity 258 and is fixed on the seat 208 by bolts.

As described above, the base 204 is positioned under the second end 220. A cylinder 214 protrudes from the base 204. The diameter of the cylinder 214 is substantially equal to the diameter of the second end 220. The cylinder 214 is positioned in the housing 206 and under the guiding column 202. The cylinder 214 has a groove 264 receiving an elastic element 266 made of rubber such as an O-ring. The elastic element 266 abuts the inner wall of the housing 206 tightly to avoid gas leakage. The base 204 has a first plane 226 having at least one locating pin 230 and a second plane 228 corresponding to the first plane 226. A convex portion 232 formed at the center of the second plane 228 is adapted to exert force.

Referring to FIGS. 2 and 3, a plane 234 is defined on the lateral surface of the housing 206. The housing 206 is disposed on the first plane 226 of the base 204 and connected to the first plane 226. The housing 206 has a central opening 236 on the top thereof, a first vent 238 and a second vent 240. The first and second vents 238, 240 are connected to a gas supply device by a pipeline. Similarly, the opening 236 has a groove 238 on the periphery thereof receiving an elastic element 270 made of rubber such as an O-ring. The elastic element 270 abuts the inner wall of the guiding column to avoid gas leakage. The housing 206 also has a first aperture 244 connected to the first vent 238 and a second aperture 246 connected to the second vent 240. In addition, the guiding column 202 and the cylinder 214 are disposed in the housing 206. The first end 218 of the guiding column 202 passes through the central opening 236 of the housing 206. The first plane 226 of the base 204 is connected to the housing 206.

In this embodiment, a cavity 258 is formed on the center of the seat 208. A plane 280 is formed on the wall of the cavity 258. The plane 234 of the housing 206 matches the plane 280 of the seat 208 so that the housing 206 cannot rotate in the cavity 258 thereby to avoid the rotation of the annular portion 210 and the pressing plate 212.

The annular portion 210 is disposed on and connected to the first plane 226 of the base 204. The annular portion 210 has a through hole 216 on the center thereof. The housing 206 passes through the through hole 216 and extends into the cavity 258. The annular portion 210 has at least one locating hole 248 corresponding to the locating pin 230 on the first plane 226 of the base 204. The pressing plate 212 is disposed under and connected to the annular portion 210.

When assembly is completed, gas is provided by a gas supply device 242 through the first aperture 244 to fill the first space 254 so as to push the housing 206 along with the annular portion 210 and pressing plate 212 moving upward (the guiding column 202 is mounted to the seat 208). The annular portion 210 may contact the seat 208 to prevent the annular portion 210 from moving up and down or rotating. When the gas is provided through the second aperture 246 by the gas supply device 242 to fill the second space 256, the housing 206 along with the annular portion 210 and the pressing plate 212 are pushed to move downward. When the housing 206 moves downward, a distance H between the convex portion 232 of the second plane 228 and the pressing plate 212 provides an appropriate space for the locating pin 230 of the base 204 escaping from the locating hole 248 of the annular portion 210. The convex portion 232 pushes the pressing plate 212 to press the substrate 260 such as a wafer (as shown in FIG. 4) and the seal 262 such as an O-ring (as shown in FIG. 4).

Figure 4:
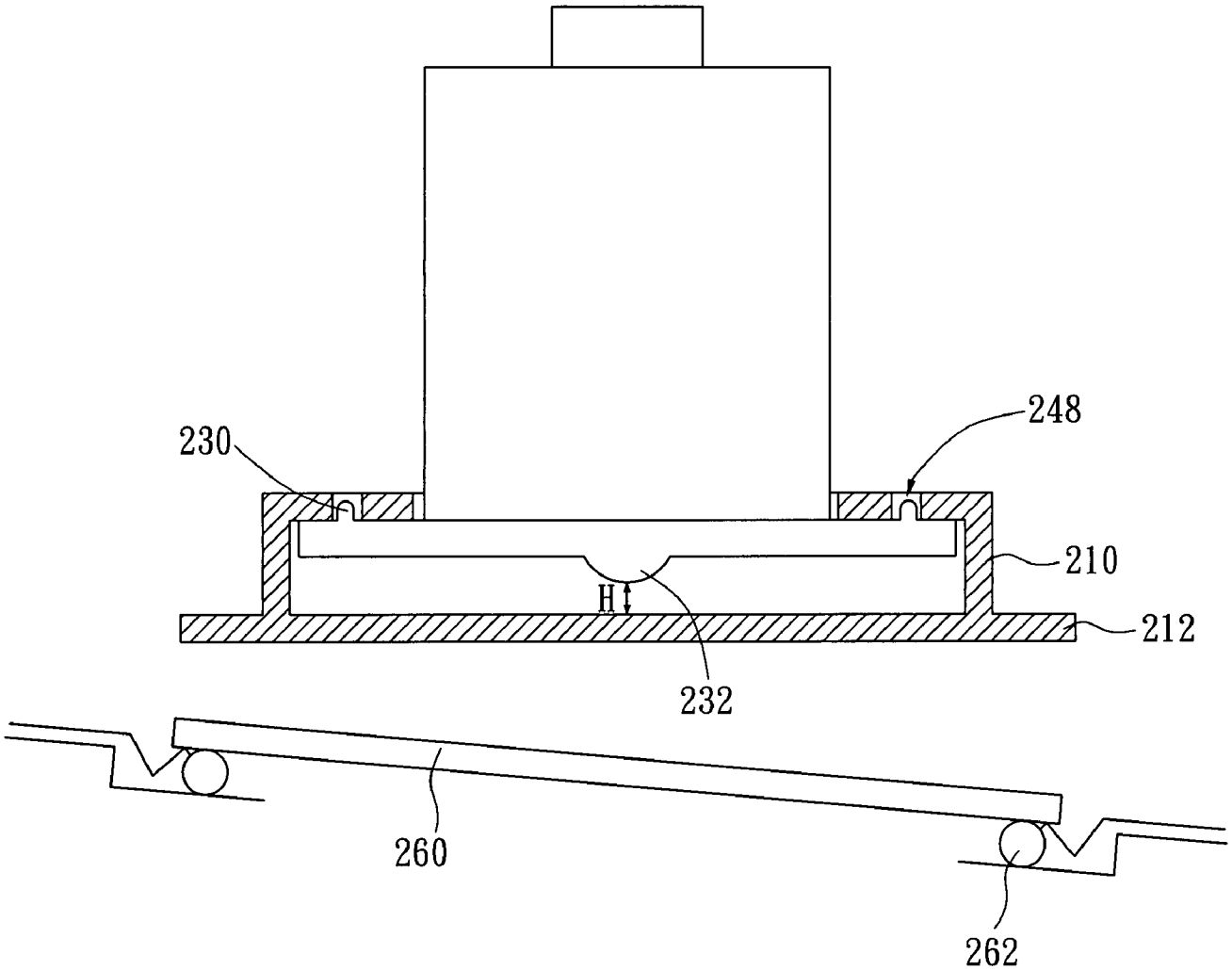
FIG. 4 is a schematic view of the compress and position apparatus of the invention showing the compress and position apparatus is inclined toward to the substrate when the compress and position apparatus has not contacted the substrate yet.

FIG. 4 is a schematic view of the compress and position apparatus of the invention showing the compress and position apparatus is inclined toward to the substrate when the compress and position apparatus has not contacted the substrate yet. Referring to FIGS. 3 and 4, when the gas is provided through the first aperture 244, and the pressing plate 212 is over the substrate 260, although the pressing plate 212 is inclined toward to the substrate 260, the locating pin 230 engages with the locating hole 248 as well as the plane 234 on the lateral surface of the housing 206 matches the plane 280 on the inner wall of the seat 208, thereby the pressing plate 212 cannot rotate. The compress and position apparatus of the invention has positioning and orientating functions.

Figure 5:
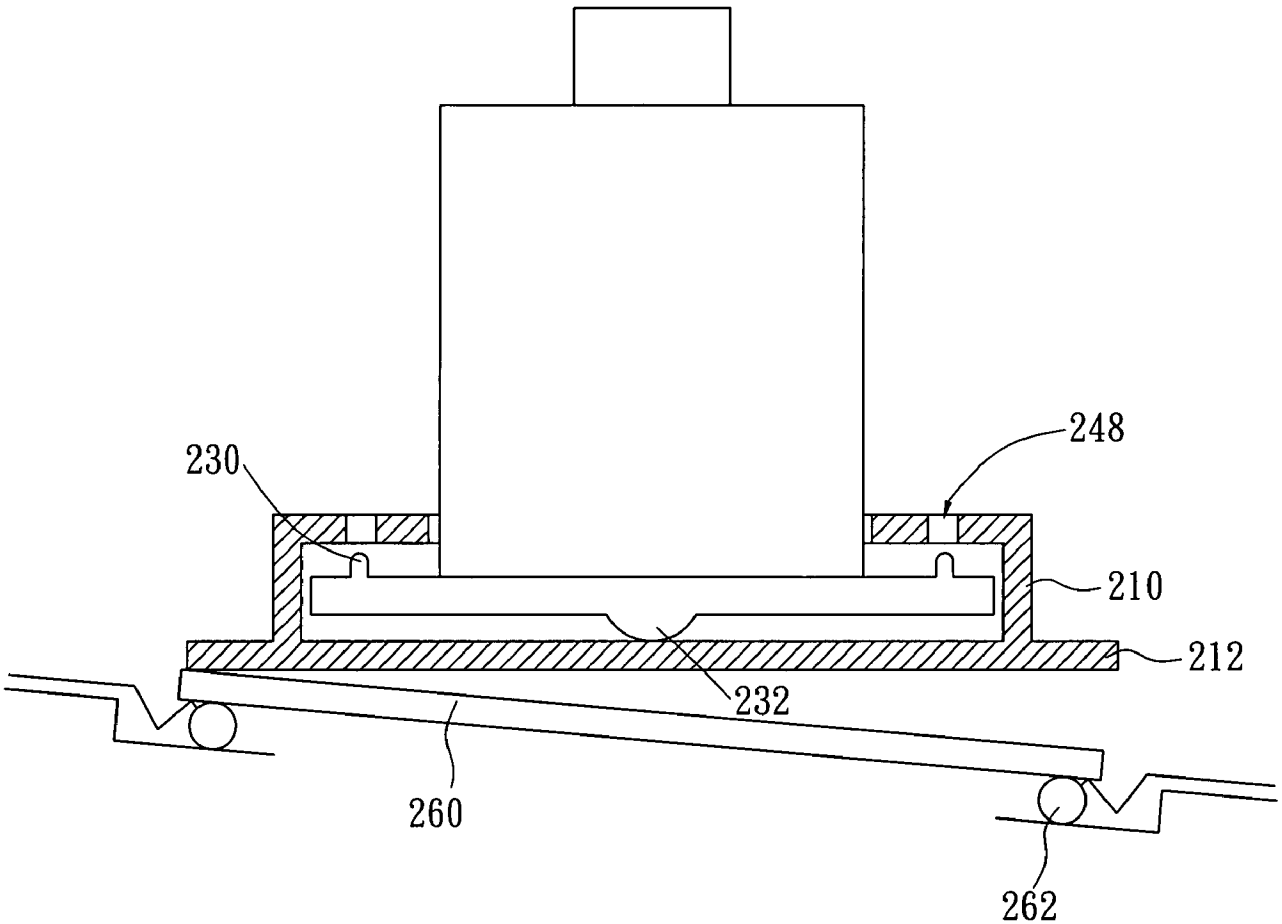
FIG. 5 is a schematic view of the pressing of the invention showing the locating pin escaping from the locating hole.

FIG. 5 is a schematic view of the pressing of the invention showing the locating pin escaping from the locating hole.

Referring to FIG. 3 and 5, when gas is provided through the second aperture 246, the housing 206 is lowered down. As the annular portion 210 is disposed on the first plane 226 of the base 212, the annular portion 210 and the pressing plate 212 is pushed downward by the housing 206. When the pressing plate 212 of the embodiment contacts the substrate 260, only a part of the weight of the pressing plate 212 is sustained by the substrate 260 due to the distance H between the base 204 and the convex portion 232. The distance H provides an appropriate space for the locating pin 230 escaping from the locating hole 248. The housing 206 moves downward until the locating pin 230 escaping from the locating hole 248 and the convex portion 232 contacting the pressing plate 212.

Figure 6:
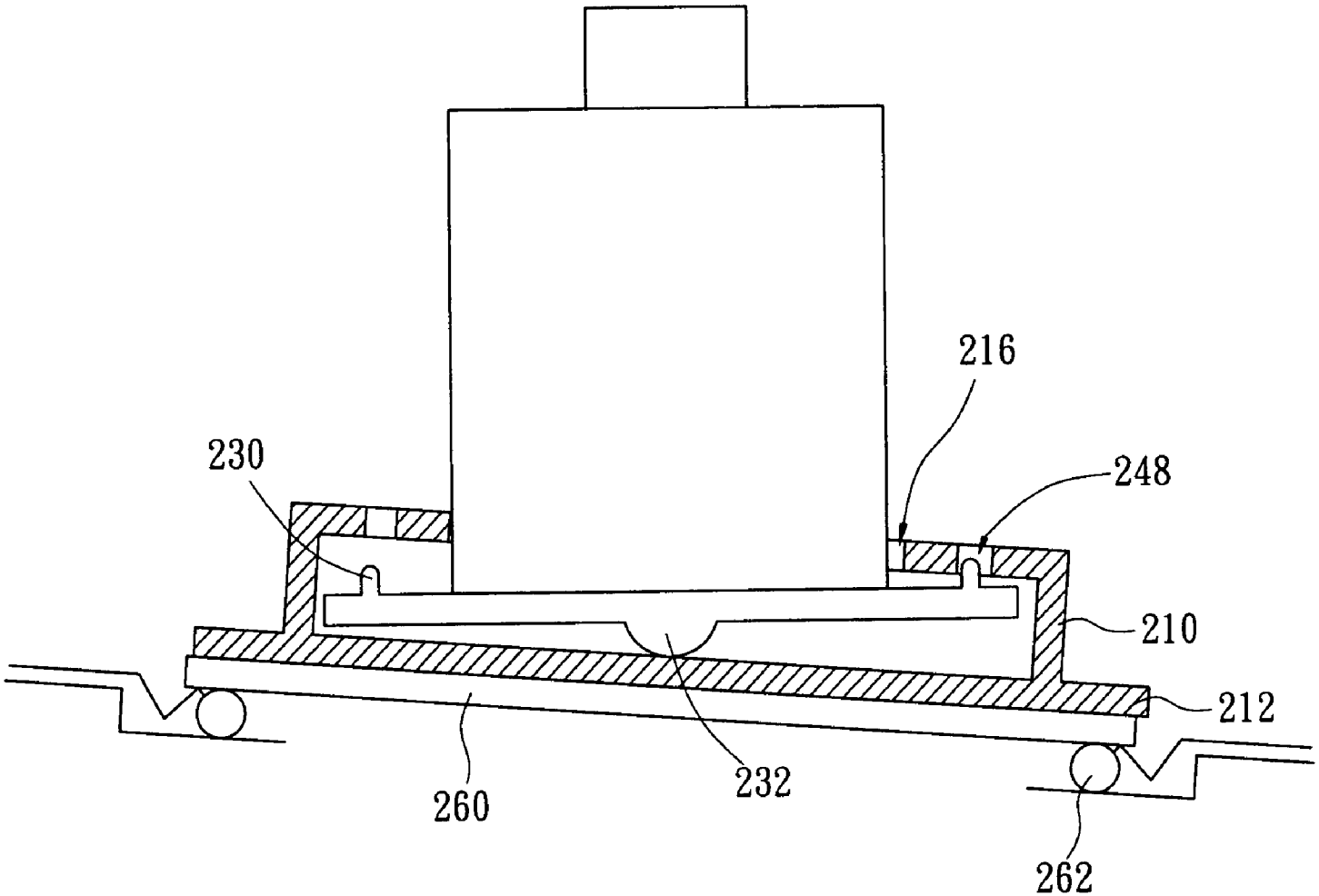
FIG. 6 is a schematic view of the compress and position apparatus showing the pressing plate pressing the substrate compliantly.

FIG. 6 is a schematic view of the compress and position apparatus showing the pressing plate abutting the substrate. Referring to FIG. 6, the pressing plate 212 has contacted the substrate 260, and the gas is continuously provided through the second aperture 246 to lower the housing 206 down. The pressing plate 212 is exerted by the convex portion 232. As the diameter of the through hole 216 is greater than the housing 206, the annular portion 210 moves downward to push the pressing plate down so that the pressing plate 212 may abut and exert a uniform force on the substrate 260.

In the embodiment described above, the pressing plate has positioning and orienteering functions by the engagement of the locating pin with the locating hole. When the locating pin escapes from the locating hole, the pressing plate may bias and press downward. The pressing force is not exerted on the pressing plate and transmitted to the substrate until the pressing plate covers the substrate compliantly. This prevents the substrate from broken due to the impact by the pressing plate. The embodiment described above is not to limit the invention, any other various modifications of the annular portion, the locating pin and the locating hole can be thought by those who are skillful in the art.

In summary, the invention has following advantages:

The compress and position apparatus of the invention has positioning and orientating functions. As the locating pin engages with the locating hole, the pressing plate will not rotate. This compress and position apparatus can be applied to plate the directional wafers and is more applicable than the conventional art.

The compress and position apparatus of the invention may passively abut the substrate. When the locating pin escapes from the locating hole, the annular portion moves downward to push the pressing plate cover the wafer so as to make the wafer abut the seal. Therefore, the seal is deformed uniformly to achieve optimal sealing effect and prevent the back of the wafer from polluting by the plating solution.

The compress and position apparatus of the invention may passively abut the substrate so that the pressing plate is allowed to incline toward the substrate. This lowers the manufacturing and assembly cost.

The compress and position apparatus of the invention may passively abut the substrate. The pressing force can be uniformly distributed on the wafer and the pressing force is not exerted on the pressing plate and transmitted to the wafer indirectly until the pressing plate abuts the wafer compliantly. This provides a buffer effect and prevents the wafer from being broken by the impact of the pressing plate.

The compress and position apparatus of the invention may passively abut the substrate. A plurality of compress and position apparatus can be applied to a multiple electroplating tank to lower the manufacturing cost.

The compress and position apparatus of the invention may passively abut the substrate. The compress and position apparatus is made of plastic so that the compress and position apparatus of the invention can be applied to certain corrosive environments.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A compress and position apparatus adapted for pressing a substrate, comprising:

a guiding column having a first end and a second end corresponding to the first end, the diameter of the second end being greater than the diameter of the first end;

a base positioned under the second end of the guiding column and having a cylinder in the center thereof, the base further having a first plane arranged thereon at least one locating pin and a corresponding second plane having a convex portion arranged at the center thereof;

a housing having a plane on lateral surface thereof and mounted on the first plane, for disposing therein the guiding column and the cylinder;

a seat having a cavity on the center thereof, in which the housing and the guiding column being disposed, the first end being connected to the seat and a plane being defined on the inner wall of the cavity;

an annular portion disposed on the first plane, having a through hole arranged at the center thereof for the housing to pass through and at least one locating hole corresponding to the locating pin;

a pressing plate disposed beneath the annular portion.

2. The compress and position apparatus of claim 1, wherein the substrate is a silicon wafer.

3. The compress and position apparatus of claim 1, wherein the second end has a groove for receiving an elastic element.

4. The compress and position apparatus of claim 3, wherein the elastic element comprises an O-ring made of rubber.

5. The compress and position apparatus of claim 1, wherein the convex portion is separated from the pressing plate by a predetermined distance for enabling the locating pin to escape from the locating hole.

6. The compress and position apparatus of claim 1, wherein the cylinder has a groove for receiving an elastic element.

7. The compress and position apparatus of claim 6, wherein the elastic element comprises an O-ring made of rubber.

8. The compress and position apparatus of claim 1, wherein the plane on the housing abuts the plane on the seat.

9. The compress and position apparatus of claim 1, wherein the housing has a central opening for the first end to pass through and a plurality of vents all defined on the top thereof and a plurality of apertures defined on the inner wall thereof, such that the vents and the apertures are connected.

10. The compress and position apparatus of claim 9, wherein the vents comprise a first vent and a second vent and the apertures comprise a first aperture connected to the first vent and a second aperture connected to the second vent.

11. The compress and position apparatus of claim 9, wherein a groove is defined on the periphery of the opening for receiving an elastic element.

12. The compress and position apparatus of claim 11, wherein the elastic element comprises and O-ring made of rubber.

13. The compress and position apparatus of claim 1, wherein the compress and position apparatus is made of plastic.

14. The compress and position apparatus of claim 1, wherein the second end is not able to cover the apertures when the housing moves up and down the guiding column.

* * * * *